US011639835B2

(12) United States Patent
Hayes

(10) Patent No.: US 11,639,835 B2
(45) Date of Patent: May 2, 2023

(54) ARROW REST ADJUSTMENT

(71) Applicant: MCP IP, LLC, Sparta, WI (US)

(72) Inventor: Mark J. Hayes, Onalaska, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 17/359,239

(22) Filed: Jun. 25, 2021

(65) Prior Publication Data

US 2021/0404763 A1 Dec. 30, 2021

Related U.S. Application Data

(60) Provisional application No. 63/044,918, filed on Jun. 26, 2020.

(51) Int. Cl.
*F41B 5/22* (2006.01)
*F41B 5/14* (2006.01)
*F41B 5/10* (2006.01)

(52) U.S. Cl.
CPC ..... *F41B 5/143* (2013.01); *F41B 5/10* (2013.01)

(58) Field of Classification Search
CPC ..... F41B 5/10; F41B 5/143
USPC ..... 124/44.5
See application file for complete search history.

(56) References Cited

U.S. PATENT DOCUMENTS 4,398,528 A * 8/1983 Troncoso, Jr. ..... F41B 5/143 124/44.5
4,664,093 A * 5/1987 Nunemaker ..... F41B 5/143 124/44.5
4,686,956 A * 8/1987 Troncoso, Jr. ..... F41B 5/143 124/44.5
4,803,971 A * 2/1989 Fletcher ..... F41B 5/143 124/44.5
4,865,007 A * 9/1989 Saunders ..... F41B 5/143 124/24.1
5,025,773 A * 6/1991 Hintze ..... F41B 5/143 124/44.5
5,137,006 A * 8/1992 Gallops ..... F41B 5/143 124/44.5
5,161,514 A * 11/1992 Cary ..... F41B 5/143 124/44.5
5,249,565 A * 10/1993 Saunders ..... F41B 5/143 124/44.5
5,353,778 A * 10/1994 Blankenship ..... F41B 5/143 124/44.5
5,447,284 A * 9/1995 Heinz ..... F41B 5/143 124/44.5
5,482,025 A * 1/1996 Finkel ..... F41B 5/143 124/44.5
5,526,800 A * 6/1996 Christian ..... F41B 5/143 124/44.5
5,529,049 A * 6/1996 Antalosky ..... F41B 5/1438 124/44.5
5,601,069 A * 2/1997 Clark ..... F41B 5/1438 124/44.5
6,430,822 B1 8/2002 Slates
(Continued)

*Primary Examiner* — Alexander R Niconovich
(74) *Attorney, Agent, or Firm* — Laabs Intellectual Property

(57) ABSTRACT

In some embodiments, an arrow rest comprises a first body portion arranged for attachment to an archery bow and a second body portion attached to the first body portion. The second body portion comprises an arrow support member. The second body portion is moveable with respect to the first body portion along an arcuate path.

17 Claims, 6 Drawing Sheets

(56) References Cited

U.S. PATENT DOCUMENTS

| | | | | |
|---|---|---|---|---|
| 6,595,195 | B1 | 7/2003 | Barner et al. | |
| 6,662,796 | B2 * | 12/2003 | St. Cyr | F41B 5/143 124/44.5 |
| 6,789,536 | B1 * | 9/2004 | Summers | F41B 5/143 124/44.5 |
| 6,913,008 | B2 * | 7/2005 | Simo | F41B 5/143 124/44.5 |
| 6,915,791 | B2 * | 7/2005 | Harwath | F41B 5/143 124/44.5 |
| 7,748,371 | B1 * | 7/2010 | Doty | F41B 5/143 124/44.5 |
| 7,913,678 | B2 * | 3/2011 | Hudkins | F41B 5/143 124/25.7 |
| 8,434,464 | B1 | 5/2013 | Terzo | |
| 8,596,253 | B2 | 12/2013 | Adams | |
| 9,285,181 | B2 | 3/2016 | Green et al. | |
| 9,341,433 | B1 | 5/2016 | Summers et al. | |
| 10,088,264 | B2 * | 10/2018 | Summers | F41B 5/143 |
| 10,156,418 | B2 | 12/2018 | Nystrom | |
| 11,105,581 | B2 | 8/2021 | Summers et al. | |
| 2003/0024516 | A1 * | 2/2003 | Mizek | F41B 5/143 124/44.5 |
| 2008/0236556 | A1 | 10/2008 | Sims et al. | |
| 2010/0006079 | A1 | 1/2010 | Harwath et al. | |
| 2013/0139798 | A1 | 6/2013 | Khoshnood | |
| 2018/0187997 | A1 | 7/2018 | Summers et al. | |
| 2021/0254923 | A1 | 8/2021 | Summers et al. | |

* cited by examiner

ARROW REST ADJUSTMENT

CROSS-REFERENCE TO RELATED APPLICATIONS

This application claims the benefit of U.S. Patent Application No. 63/044,918, filed Jun. 26, 2020, the entire content of which is hereby incorporated herein by reference.

BACKGROUND OF THE INVENTION

This invention relates generally to archery and more specifically to arrow rests.

Archery bows are generally known in the art and are used to launch arrows. While the bow is drawn and aimed, an arrow is often supported at two locations—the nocking point and the arrow rest. An arrow rest desirably supports the arrow during the aiming process but does not impact or interfere with the arrow during the launch event.

There remains a need for novel arrow rest designs that provide benefits beyond the capabilities of known arrow rest designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an arrow rest comprises a first body portion arranged for attachment to an archery bow and a second body portion attached to the first body portion. The second body portion comprises an arrow support member. The second body portion is moveable with respect to the first body portion along an arcuate path.

In some embodiments, the first body portion comprises a track and the track comprises an arcuate shape.

In some embodiments, the arrow support member comprises a contact point arranged to contact an arrow. In some embodiments, moving the second body portion with respect to the first body portion rotates the arrow support member about the contact point. In some embodiments, the contact point comprises a center of the arcuate path.

In some embodiments, the arrow rest comprises an adjustment mechanism arranged to move the second body portion with respect to the first body portion.

In some embodiments, an arrow rest comprises a first body portion and a second body portion. The first body portion is arranged for attachment to an archery bow and comprises a track comprising an arcuate shape. The second body portion is attached to the first body portion and moveable with respect to the first body portion along the track. The second body portion comprises an arrow support member.

In some embodiments, the arcuate shape comprises a rotation axis and the arrow support member extends in a radial direction from the rotation axis.

In some embodiments, the arcuate shape comprises a rotation axis and the arrow support member intersects the rotation axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
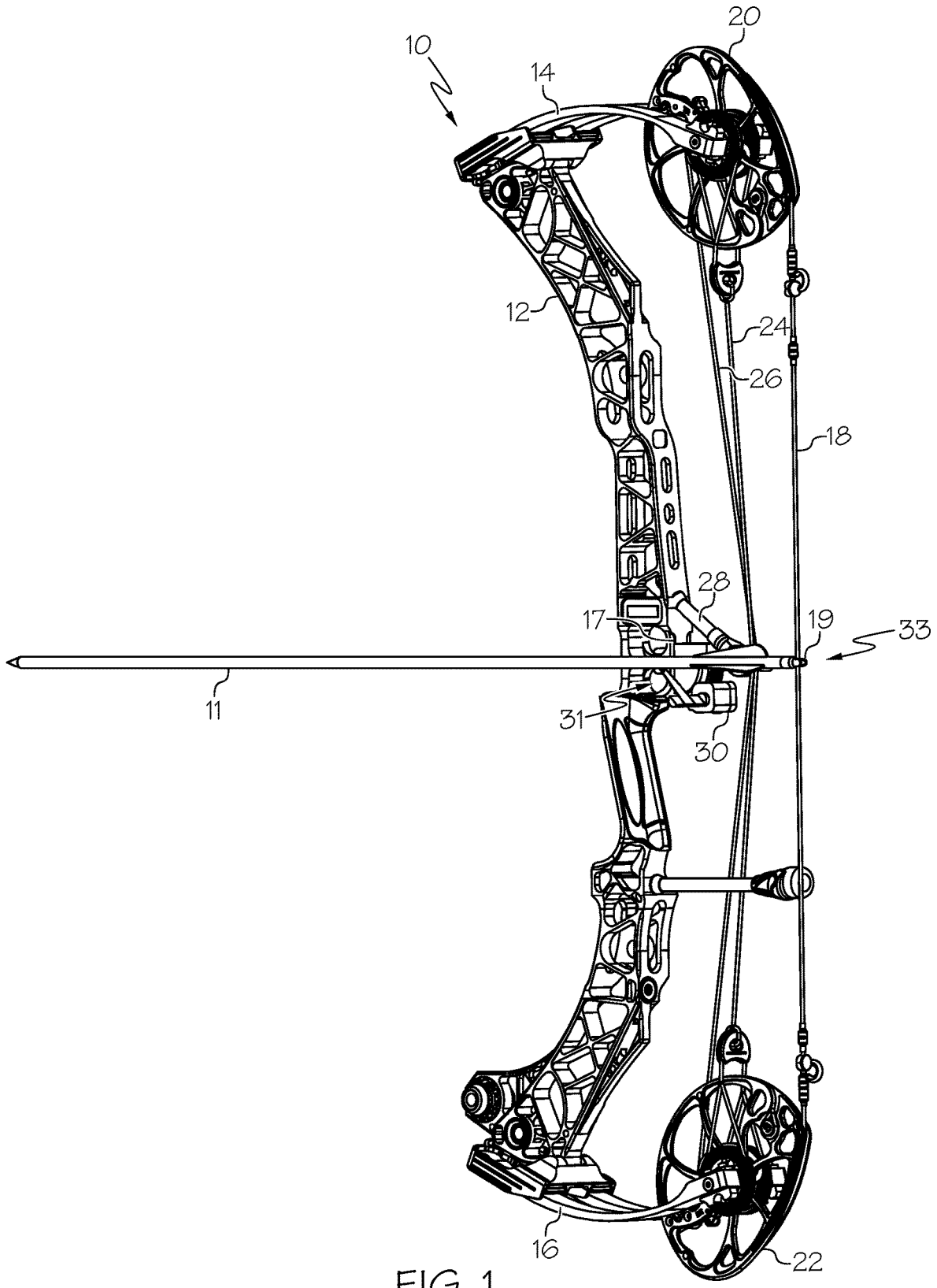
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. In some embodiments, a bow 10 comprises a riser 12, a first limb 14, a second limb 16 and a bowstring 18. In some embodiments, a bow 10 further comprises a first rotatable member 20, a second rotatable member 22, a first power cable 24 and a second power cable 26. In some embodiments, the bow 10 comprises a cable guard 28 arranged to displace the cables 24, 26 away from the shooting axis.

In some embodiments, the bow 10 comprises an arrow rest 30. Desirably, the arrow rest 10 is arranged to support an arrow 11. In some embodiments, a bow 10 supports an arrow 11 at a first location 31 and a second location 33. In some embodiments, the first location 31 comprises a contact location between the arrow 11 and the arrow rest 30. In some embodiments, the second location 33 comprises a contact location between the arrow 11 and the bowstring 18. In some embodiments, the second location 33 comprises a nocking point 19.

Figure 2:
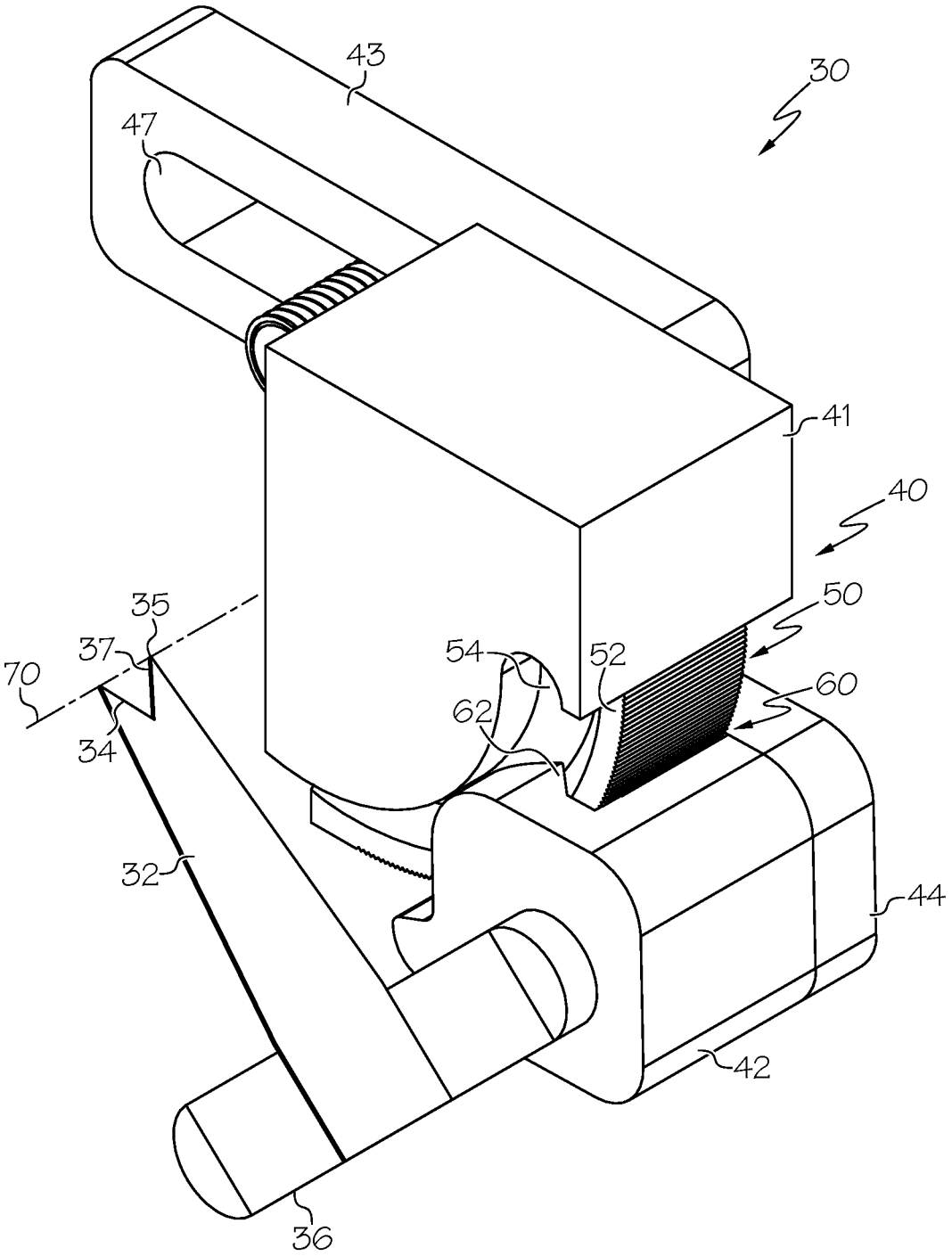
FIG. 2 shows an embodiment of an arrow rest.
Figure 3:
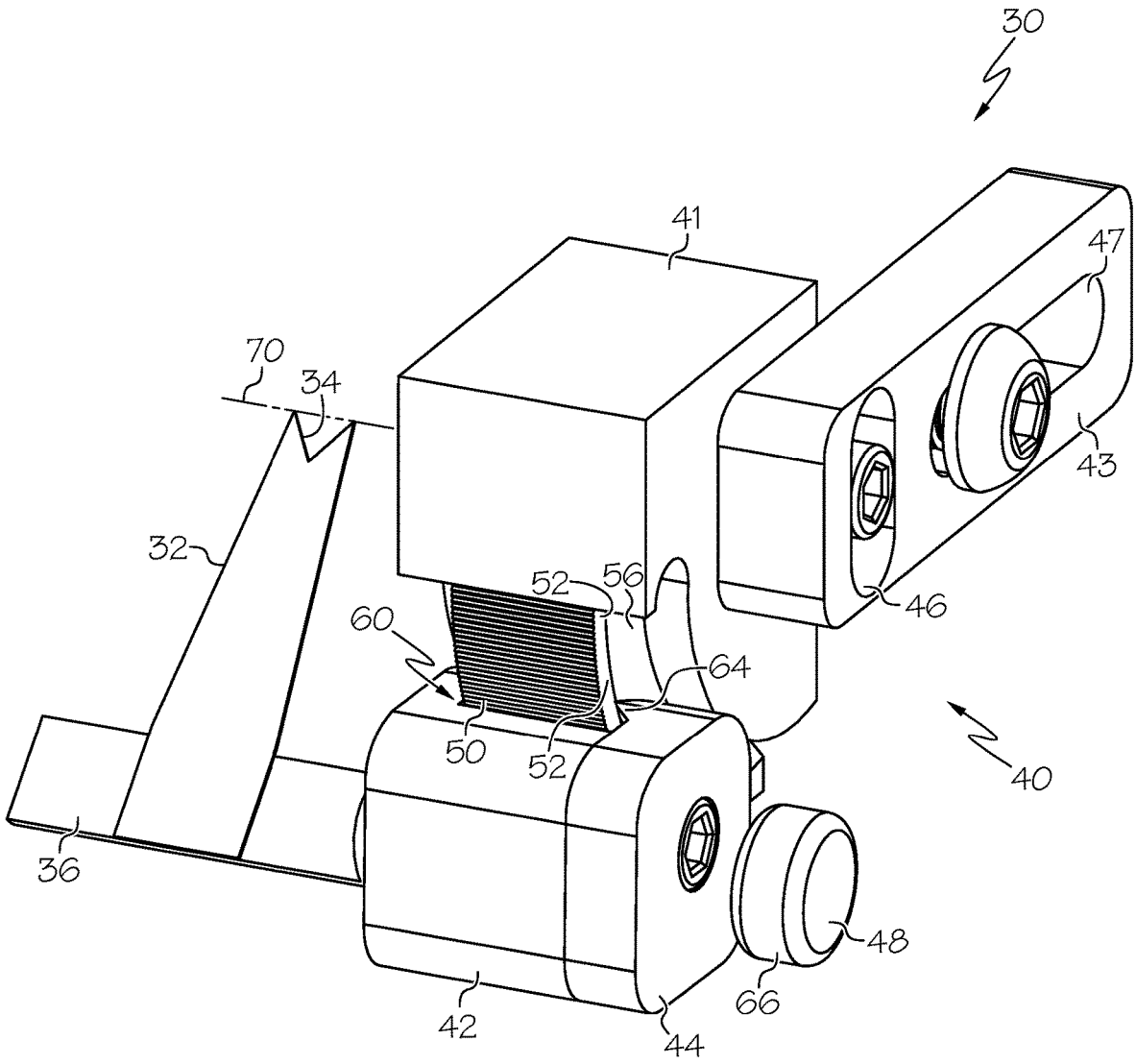
FIG. 3 shows another view of an embodiment of the arrow rest.
Figure 4:
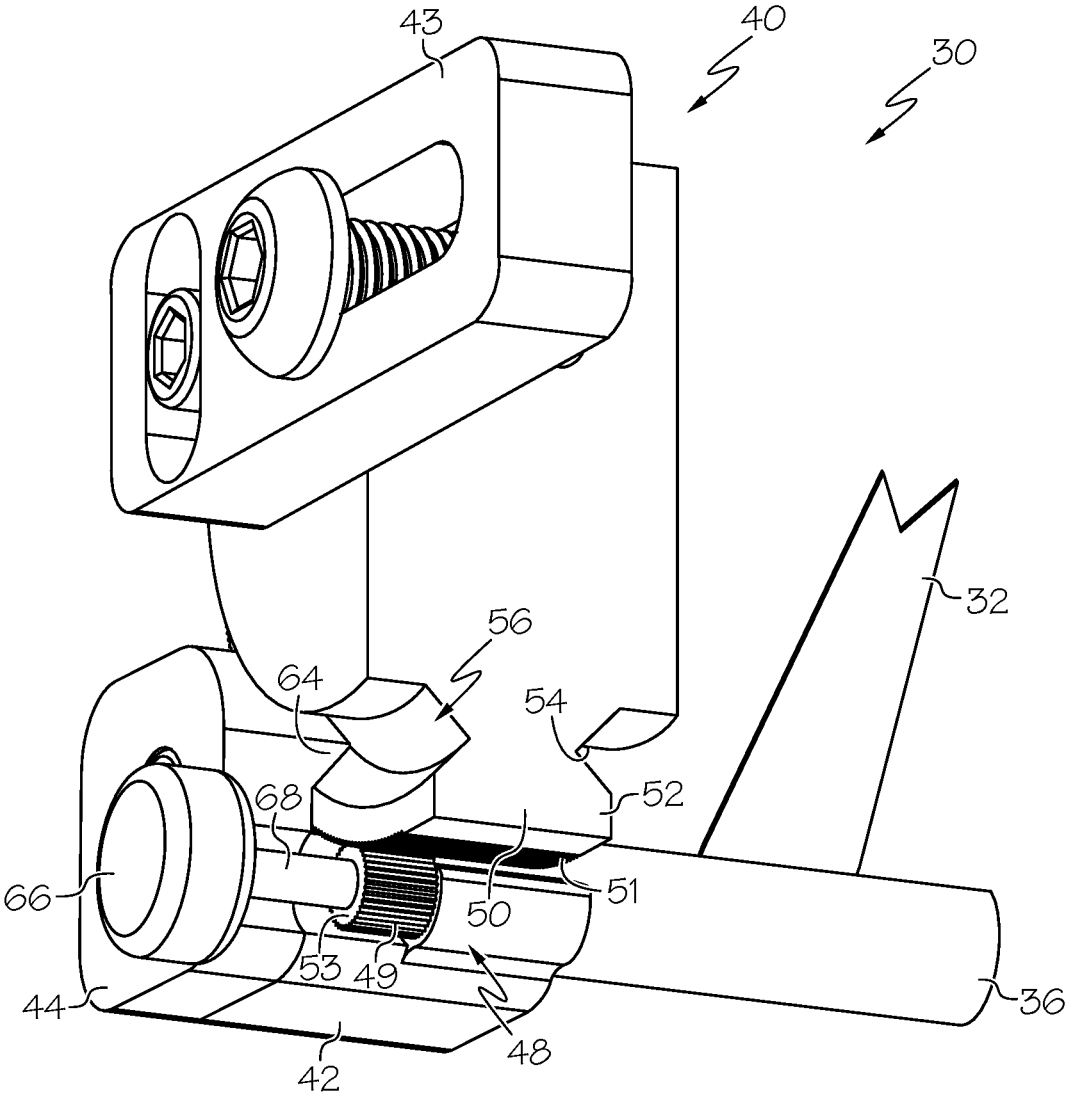
FIG. 4 shows another view of an embodiment of the arrow rest.
Figure 5:
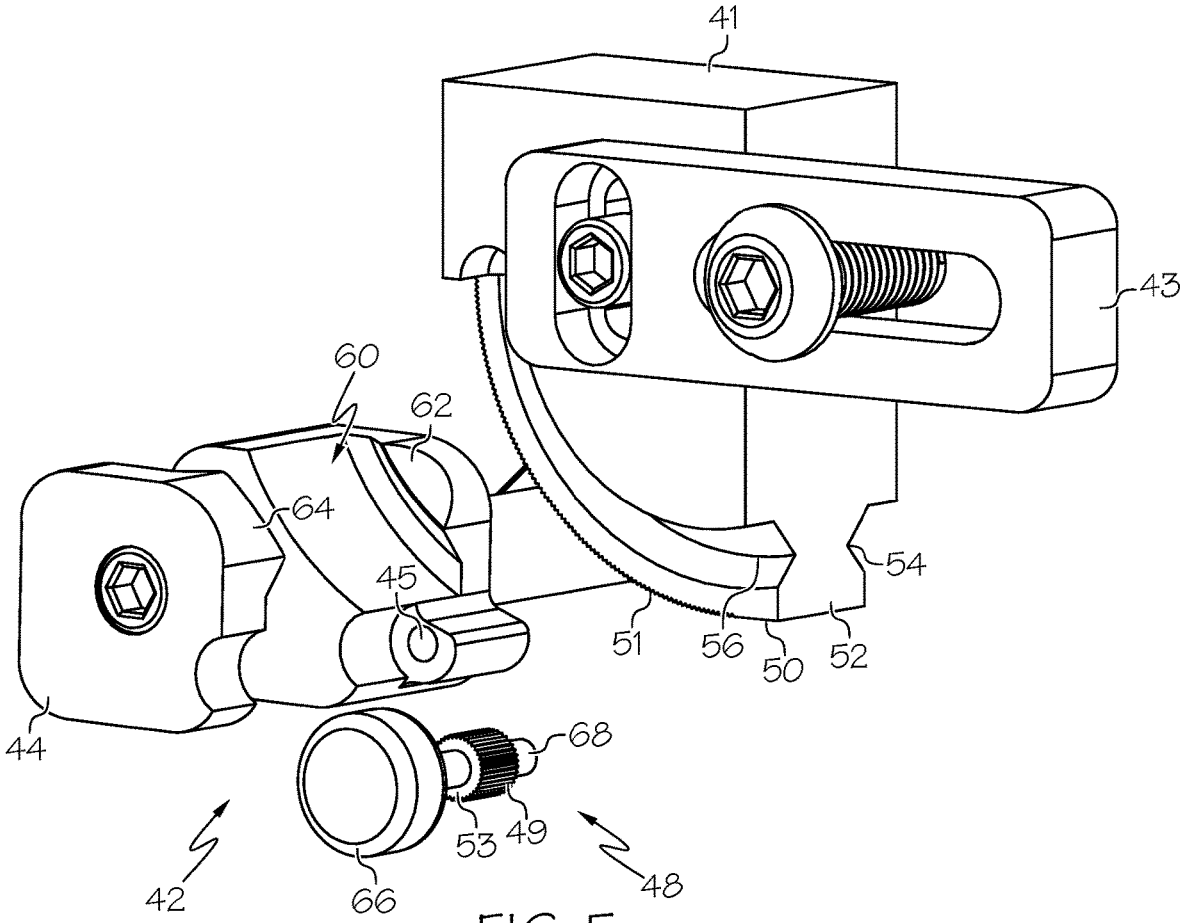
FIG. 5 shows an exploded view of an embodiment of the arrow rest.

FIG. 2-4 show different views of an embodiment of an arrow rest 30. FIG. 5 shows an exploded view.

Desirably, an arrow rest 30 comprises a body 40 arranged for attachment to an archery bow. Desirably, the arrow rest 30 comprises a support member 32 arranged to contact and support an arrow. In some embodiments, the support member 32 comprises a notch 34 arranged to receive an arrow. In some embodiments, the support member 32 is supported by the body 40.

In some embodiments, the body 40 comprises a first body portion 41 and a second body portion 42. In some embodiments, the second body portion 42 is moveable with respect to the first body portion 41. In some embodiments, the first body portion 41 is arranged for attachment to an archery bow and the second body portion 42 comprises the support member 32. Thus, in some embodiments, movement of the second body portion 42 with respect to the first body portion 41 can move the support member 32 with respect to the archery bow.

In some embodiments, the second body portion 42 is arranged to move along an arcuate path with respect to the first body portion 41. In some embodiments, the first body portion 41 comprises a track 50 and the track 50 comprises an arcuate shape. In some embodiments, the second body portion 42 is arranged to move along a length of the track 50.

In some embodiments, a track 50 comprises a raised portion 52. In some embodiments, the second body portion 42 comprises a cavity 60 and the raised portion 52 is oriented in the cavity 60. In some embodiments, the raised portion 52 comprises a contoured shape and the cavity 60 comprises a complimentary shape. In some embodiments, the raised portion 52 comprises a dovetail shape.

In some embodiments, a track 50 comprises a recess 54. In some embodiments, a recess 54 comprises an arcuate shape. In some embodiments, the second body portion 42 comprises a protrusion 62 oriented in the recess 54. In some embodiments, a track 50 comprises a second recess 56. In some embodiments, the second body portion 42 comprises a second protrusion 64 oriented in the second recess 56.

In some embodiments, the arrow rest 30 defines a rotation axis 70. In some embodiments, the second body portion 42 rotates about the rotation axis 70 as the second body portion 42 moves with respect to the first body portion 41. In some embodiments, the rotation axis 70 comprises the center of an arcuate path traveled by the second body portion 42. In some embodiments, the rotation axis 70 comprises the center of an arcuate shape defined by the track 50. In some embodiments, the rotation axis 70 comprises the center of an arcuate shape defined by a recess 54, 56.

In some embodiments, a portion of the support member 32 is oriented on the rotation axis 70. In some embodiments, a tip 35 of the support member 32 is oriented on the rotation axis 70. In some embodiments, a contact point 37 comprises a location of contact between the support member 32 and an arrow being supported by the support member 32. In some embodiments, one or more contact point(s) 37 are located on the rotation axis 70. In some embodiments, a contact point 37 is offset from a tip 35 of the support member 32. In some embodiments, contact point(s) 37 are located along surface(s) of the notch 34.

In some embodiments, a length of the support member 32 is oriented in a radial direction with respect to the rotation axis 70. In some embodiments, at least a portion of the support member 42 is oriented parallel to a reference line oriented in a radial direction extending from the rotation axis 70.

In some embodiments, the support member 32 comprises a fixed-blade style arrow rest, wherein the arrow rest 30 remains relatively static as an arrow is launched.

In some embodiments, the support member 32 is arranged to move as the bow is drawn and/or an arrow is launched. For example, in some embodiments, the support member 32 is arranged to drop away as an arrow is launched. In some embodiments, the second body portion 42 comprises a support arm 36 arranged to support the support member 32. In some embodiments, the support arm 36 and support member 32 are arranged to move as an arrow is launched. In some embodiments, the support arm 36 and support member 32 are arranged to rotate with respect to the second body portion 42 as an arrow is launched. In some embodiments, the support arm 36 and support member 32 are arranged to rotate about a central axis of the support arm 36. The movement of the support member 32 can be achieve using any suitable structure. In some embodiments, the arrow rest 30 comprises features as described by U.S. Pat. Nos. 6,634,349, 6,789,536, 7,963,279 and/or US 2017/0074614, the entire contents of which are hereby incorporated herein by reference.

In some embodiments, the second body portion 42 comprises a key 44. In some embodiments, movement or detachment of the key 44 allows the second body portion 42 to disengage the first body portion 41. In some embodiments, the key 44 at least partially defines the cavity 60. In some embodiments, the key 44 comprises a protrusion 64.

In some embodiments, the body 40 further comprises a third body portion 43. In some embodiments, the third body portion 43 is attached to the first body portion 41. In some embodiments, the third body portion 43 is arranged for attachment to an archery bow 10 and allows for adjustment of the first body portion 41 with respect to the archery bow 10. In some embodiments, the third body portion 43 comprises a first slot 46 arranged for adjustment of the first body portion 41 with respect to the archery bow 10 in a first direction, such as a vertical adjustment. In some embodiments, the third body portion 43 comprises a second slot 46 arranged for adjustment of the first body portion 41 with respect to the archery bow 10 in a second direction, such as a horizontal direction.

In some embodiments, the first body portion 41 is configured to engage an archery bow 10, for example comprising a mounting arrangement as disclosed in US 2020/0132410, the entire content of which is hereby incorporated herein by reference.

In some embodiments, the first body portion 41 comprises a clamp structure arranged to engage a riser 12. In some embodiments, the arrow rest 30 is arranged to engage a dovetail 17, for example integrated into a riser 12 (see FIG. 1).

In some embodiments, the arrow rest 30 comprises an adjustment mechanism 48 arranged to control movement of the second body portion 42 with respect to the first body portion 41. In some embodiments, an adjustment mechanism 48 comprises an actuation mechanism arranged to move the second body portion 42 with respect to the first body portion 41. In some embodiments, an adjustment mechanism 48 comprises a first portion engaged with the second body portion 42 and a second portion engaged with the first body portion 41. In some embodiments, the adjustment mechanism 48 is rotatable. In some embodiments, the adjustment mechanism 48 comprises a dial 66.

In some embodiments, the adjustment mechanism 48 is rotatably engaged with a portion of the body 40. In some embodiments, the adjustment mechanism 48 is rotatably engaged with the second body portion 42. In some embodiments, the adjustment mechanism 48 comprises a shaft 68, and the adjustment mechanism 48 rotates about an axis of the shaft 68. In some embodiments, a portion of the shaft 68 is received in a cavity 45.

In some embodiments, the actuation mechanism 48 is engaged with the first body portion 41. In some embodiments, movement of the actuation mechanism 48 moves the second body portion 42 along an arcuate path with respect to the first body potion 41. In some embodiments, a surface 49 of the adjustment mechanism 48 contacts a surface 51 of the first body portion 41. In some embodiments, a surface 49 of the adjustment mechanism 48 contacts a complimentary surface 51 of the track 50. In some embodiments, the adjustment mechanism 48 comprises a roller 53 and an outer surface of the roller 53 comprises the surface 49 in contact with the complimentary surface 51 of the first body portion 41. In some embodiments, the surfaces 49, 51 are shaped to engage one another. In some embodiments, the surface 49 comprises gearing, teeth or the like, and the complimentary surface 51 comprises complimentary gearing, teeth or the like.

Figure 6:
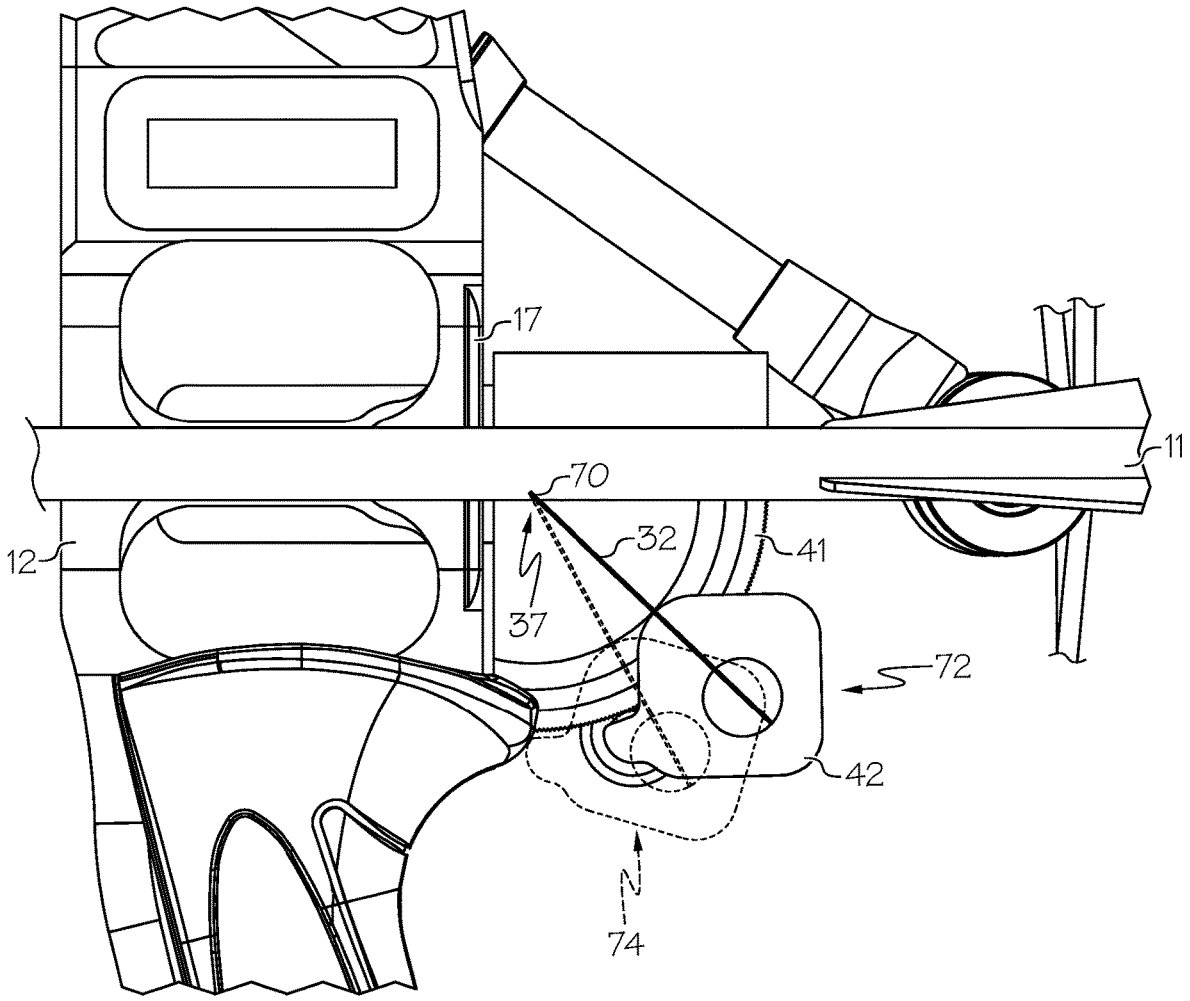
FIG. 6 shows an embodiment of an arrow rest on a bow at multiple orientations.

FIG. 6 shows an embodiment of an arrow rest 30 attached to the riser 12 of an archery bow 10. The arrow rest 30 is shown at a first orientation 72 with respect to the riser 12. The arrow rest 30 is also shown at a second orientation 74 with respect to the riser 12. The position of the second body portion 42 with respect to the riser 12 has changed, as well as the orientation and angle of the support member 32. In moving from the first orientation 72 to the second orientation 74, the second body portion 42 has moved along an arcuate path with respect to the first body portion 41. The support member 32 and second body portion 42 have moved in a rotation about the rotation axis 70. The support member 32 contacts the arrow 11 at contact points 37 positioned on the rotation axis 70. Thus, the orientation of the support member 32 can be adjusted with respect to the riser 12 without any need to reposition the body 40/41 of the arrow rest 30 upon the riser 12.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An arrow rest comprising:

a first body portion arranged for attachment to an archery bow; and a second body portion attached to the first body portion, the second body portion comprising an arrow support member arranged to support an arrow along a shooting axis, the second body portion moveable with respect to the first body portion along an arcuate path about a rotation axis, the rotation axis non-parallel to the shooting axis, the arrow support member comprising a contact point arranged to contact an arrow, wherein moving the second body portion with respect to the first body portion rotates the arrow support member about the contact point.

2. The arrow rest of claim 1, the first body portion comprising a track, the track comprising an arcuate shape.

3. The arrow rest of claim 2, the second body portion comprising a cavity, a portion of the track oriented in the cavity.

4. The arrow rest of claim 1, the first body portion comprising a recessed channel, the recessed channel comprising an arcuate shape.

5. The arrow rest of claim 4, the second body portion comprising a protrusion oriented in the recessed channel.

6. The arrow rest of claim 5, the recessed channel comprising a first recessed channel, the first body portion comprising a second recessed channel, the second recessed channel comprising a shape similar to the first recessed channel, the second recessed channel comprising an orientation different from the first recessed channel.

7. The arrow rest of claim 6, the protrusion comprising a first protrusion, the second body portion comprising a second protrusion, the second protrusion oriented in the second recessed channel.

8. The arrow rest of claim 1, the contact point comprising a center of the arcuate path.

9. The arrow rest of claim 1, comprising an adjustment mechanism arranged to move the second body portion with respect to the first body portion.

10. The arrow rest of claim 9, the adjustment mechanism rotatably engaged with the second body portion.

11. The arrow rest of claim 10, the adjustment mechanism comprising a roller, the roller contacting the first body portion.

12. The arrow rest of claim 9, the adjustment mechanism comprising gear teeth.

13. The arrow rest of claim 1, the rotation axis orthogonal to the shooting axis.

14. An arrow rest comprising:

a first body portion arranged for attachment to an archery bow, the first body portion comprising a track, the track comprising an arcuate shape; and a second body portion attached to the first body portion, the second body portion comprising an arrow support member arranged to support an arrow along a shooting axis, the second body portion moveable with respect to the first body portion along the track about a rotation axis, the rotation axis non-parallel to the shooting axis, the second body portion comprising a first position and a second position with respect to the first body portion, the arrow support member intersecting the rotation axis in the first position and the second position.

15. The arrow rest of claim 14, the arrow support member extending in a radial direction from the rotation axis.

16. The arrow rest of claim 14, the rotation axis orthogonal to the shooting axis.

17. The arrow rest of claim 14, comprising an adjustment mechanism arranged to move the second body portion with respect to the first body portion, the first body portion comprising a first arcuate surface comprising first gear teeth, the second body portion comprising a second arcuate surface comprising second gear teeth, the first gear teeth engaged with the second gear teeth.

* * * * *